US005256076A

United States Patent [19]

Hamlin

[11] Patent Number: 5,256,076

[45] Date of Patent: Oct. 26, 1993

[54] SAFETY ELECTRICAL RECEPTACLE

[76] Inventor: Jay T. Hamlin, 2314 W. Sagebrush Dr., Chandler, Ariz. 85224

[21] Appl. No.: 684,048

[22] Filed: Apr. 10, 1991

[51] Int. Cl.[5] ..... H01R 13/703

[52] U.S. Cl. ..... 439/188; 200/51.09

[58] Field of Search ..... 439/188; 200/51.09

[56] References Cited

U.S. PATENT DOCUMENTS

| | | | |
|---|---|---|---|
| 3,270,249 | 8/1966 | Unsworth | 317/99 |
| 3,596,019 | 7/1971 | Koester | 200/51.09 |
| 3,755,635 | 8/1973 | McGill | 200/51.09 |
| 3,775,726 | 11/1973 | Gress | 339/14 |
| 3,828,224 | 8/1974 | Hulshizer | 317/112 |
| 3,942,856 | 3/1976 | Mindheim | 399/74 |
| 4,008,382 | 2/1977 | De Ross | 200/51 |
| 4,167,658 | 9/1979 | Sherman | 200/44 |
| 4,464,550 | 8/1984 | Soes | 200/46 |
| 4,758,696 | 7/1988 | Grazer | 439/188 |
| 4,767,359 | 8/1988 | Martell | 439/535 |

*Primary Examiner*—Neil Abrams

[57] ABSTRACT

A safety electrical receptacle for household, commercial, or industrial use is described which will not transmit electrical energy through an electrical plug to output wiring until normally open switches positioned in the path of travel of the electrical plug are closed by the motion of the plug being inserted into the receptacle. An open receptacle exists in a safe condition because normally open switches are connected in series with the contacts and no voltage is available to shock or burn the adult or child who inadvertently inserts a conductive object into the receptacle. In one embodiment of the invention, posts incorporated into a specially designed plug act to close switches and allow the transmission of electrical energy to output wiring. In another embodiment, a conventional grounding tine on a plug acts to close switches which transmit electrical energy to output wiring.

3 Claims, 1 Drawing Sheet

FIG. 1
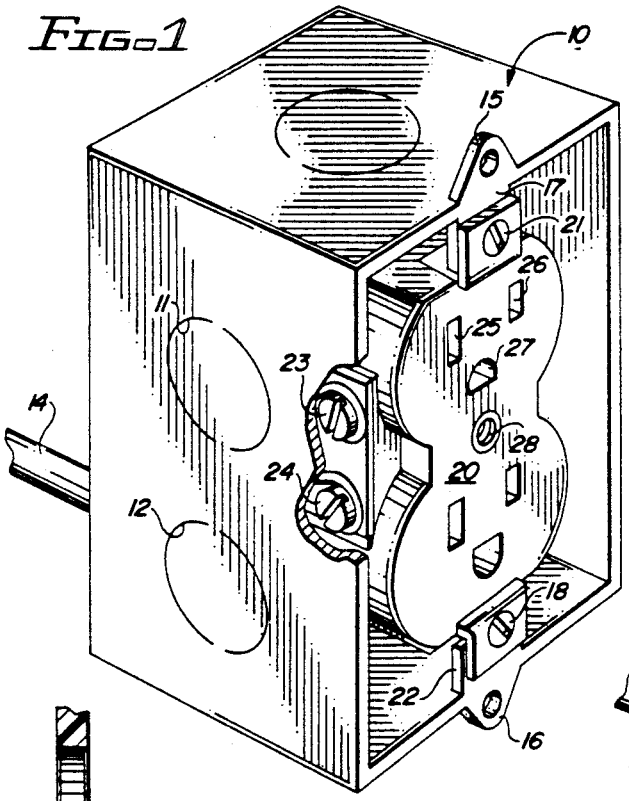
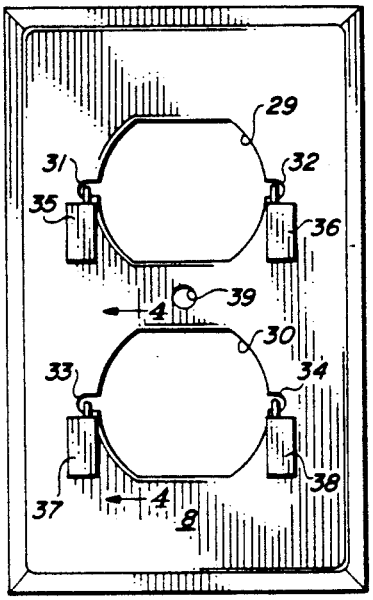
FIG. 2
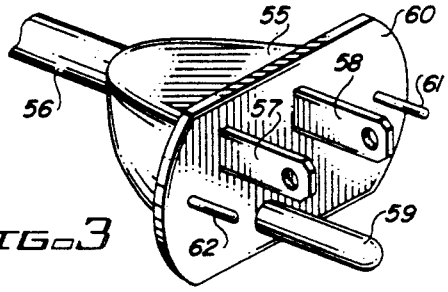
FIG. 3
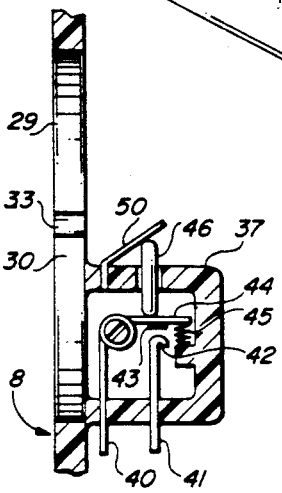
FIG. 4
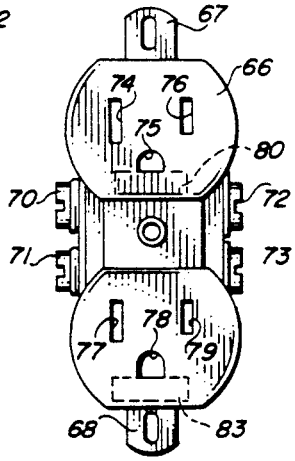
FIG. 5
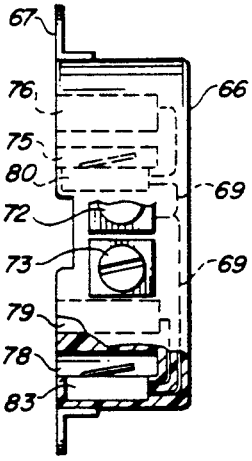
FIG. 6

SAFETY ELECTRICAL RECEPTACLE

FIELD OF THE INVENTION

The invention relates to an electrical receptacle for household, commercial, or industrial use that will not transmit electrical energy until certain conditions are complied with, thereby reducing the probability of damage to children or to people who may inadvertently introduce metal objects into engagement with the live contacts of the receptacle sockets.

PRIOR ART

The common duplex electrical wall receptacle in general usage in homes and offices can be dangerous to persons, particularly children, who may introduce metal such as wire, pins, or paper clips into the sockets. More generally, all electric receptacles for household, commercial, or industrial use can be dangerous to persons who may receive an electrical shock or burn by inserting a defective plug into a conventional socket. In some cases a partial insertion of an otherwise operable plug into a socket can result in the overheating of the contacts, or even arcing, as the current flows because of inadequate contact surface engagement. Thus, conventional electrical receptacles are inadequate from the standpoint of safety, to fulfill a need, and the invention presented herein is intended to overcome their deficiencies.

SUMMARY OF THE INVENTION

Safety in the distribution and use of electrical energy is a primary object of those who design and construct high voltage distribution systems. However, in the home or in a commercial or industrial setting where voltage as high as 240 volts are available, the conventional receptacle is frequently located on or near the floor, available to children and offering the spaced plug-contact apertures which open into live contacts only fractions of an inch behind a face plate. A child who may thrust a wire or pin into the aperture, or an adult who may inadvertently induce a metallic object into the aperture, may receive a damaging burn or electrical shock.

It is therefore a broad object of my invention to provide an electrical receptacle which will receive conventional electrical plugs and which is easily installed in residences, in commercial facilities and industrial plants but will not transmit electrical energy until certain safety conditions are complied with and satisfied.

It is another object of my invention to provide an electrical receptacle having an outlet which will not transmit electrical energy to output wiring until normally open switches positioned in the path of travel of a plug are closed by the motion of the plug being inserted into the outlet.

It is yet another object of my invention to provide an electrical receptacle having an outlet wherein a normally open switch is connected in series with at least one outlet contact and is positioned in the path of travel of the plug's grounding tine to be closed by the plug's insertion into the outlet.

It is yet still another object of my invention to provide an electrical receptacle which will not transmit electrical energy if a plug having no grounding tine is inserted into its outlet.

Other objects and features of the invention are apparent from the following drawings and description which reveal the best modes of the invention.

THE DRAWINGS

FIG. 1 is a perspective view of a receptacle having an outlet positioned therein.

FIG. 2 is a rear view of a receptacle-face plate showing details of one species of the invention.

FIG. 3 is a perspective view of a plug to be used with the receptacle and face plate of FIGS. 1 and 2.

FIG. 4 is an enlarged view in cross section showing a normally-open switch usable with the invention.

FIG. 5 is an elevation view of an outlet usable with a receptacle, as another species of my invention.

FIG. 6 is a side view of the outlet of FIG. 5.

DETAILED DESCRIPTION

Referring now to the drawing, the preferred embodiment of FIG. 1 to 4 show a conventional receptacle box 10 provided with a plurality of apertures 11, 12 to receive electrical input cable or conduit 14. Ears 15 and 16 are formed at the top and bottom face of box 10 and are pierced by holes to receive a securing means such as a nail or wood screw when the box is installed in a wall. Depending tabs 17 and 22 are provided on the inside of the receptacle to support a standard duplex outlet 20 which is secured to the tabs by machine screws 18 and 21. The outlet has terminals 23 and 24 to receive the ends of cable 14 to thereby transmit voltage to contacts (not shown) behind apertures 25 and 26. Grounding aperture 27 may be internally connected to ground or it may receive the grounding wire of cable 14. A threaded hole 28 is intended to accept a machine screw to hold a face plate to the receptacle in the usual manner.

Referring now to FIG. 2 which is a rear view of a receptacle face plate 8 it is there seen that the apertures 29 and 30 formed to receive the front surfaces of duplex outlet 20 each have two kerfs 31, 32, 33, 34 positioned diametrically opposite each other for a purpose that will later be explained. Four normally open switches 35, 36, 37 and 38 are secured to the face plate and have their operating levers closely adjacent each respective kerf. Hole 39 will receive a machine screw (not shown) that is threaded into hole 28 to secure the face plate to the outlet.

FIG. 4 is an enlarged representation of the normally open switches 35, 36, 37 and 38 which are secured to the face plate 8 of FIG. 2. Wires 41 and 40 lead, respectively, to fixed contact 42 and movable contact 43. Movable contact 43 is carried by arms 44 and 46 which are biased upward by spring 45. When operating lever 50 is forced downward against the urging of spring 45, then contacts 42 and 43 engage, and wires 40 and 4 1 are connected one to another.

FIG. 3 shows a hand-held plug generally designated by reference character 55. The usual output power line 56 is shown, and the conventional tines 57, 58 and grounding tine 59 are illustrated. The three tines pierce insulating plate 60 which carries posts 6 1 and 62. Note that the lateral spacing between posts 6 1 and 62 conforms to the space in between kerfs 31, 32 and between 33, 34.

OPERATION

If a conventional plug or a metallic object is inserted into the outlet 20, no power will be available to the output line because normally open switches 35, 36 or 37, 38, which are connected in series with the contacts, are open and no voltage will be available to shock or burn the adult or child who has inserted the object. Thus, the outlet remains in a safe condition. However, if the plug of FIG. 3 is inserted into the outlet, posts 61 and 62 enter for example kerfs 31 and 32 and depress the actuating lever of switches 35 and 36 thus connecting the input voltage from the power source to the output lines from the plug and the load connected to the plug receives electrical energy for operation.

Considering now the species of safety device shown in FIGS. 5 and 6, disclosing a duplex outlet 66 having ears 67 and 68 for convenient attachment to a receptacle box, terminal posts 70–73 inclusive and apertures 74–79 inclusive, and opening to the electrical contacts. Normally open switches 80 and 83 are shown each having an operating arm placed in the path of travel of the grounding tine of an output power plug. Wiring, shown generally as 69, connects the normally open switch in series with the main voltage contact.

If a plug with the ground tine missing is inserted into aperture 74 and 76, then no connection is made because the normally open switch 80 has not had its operating lever depressed to close the switch. If however, a plug is used that has its ground tine in position, the ground tine will engage the switch's operating arm to move it to switchclosed position and electrical energy will flow to the load or appliance connected to the plug.

The preferred embodiments described herein disclose an electrical device utilizing a normally open switch, or combination of switches, connected in series with the receptacle contacts which is closed by operation or insertion of a plug into an outlet to connect input electrical energy to output lines to a load or an appliance. It should be apparent that the components herein described could be arranged or maintained differently to form a safety receptacle requiring movements of its components to effect an energy transfer. Such rearrangement would not depart from the scope of the hereinafter claimed structure which I regard as my invention.

I claim:

1. A safety electrical system having means for connecting incoming wires from a power source to outgoing wires to a power user comprising:

(a) an outlet receptacle having terminals posts to accept incoming wires, said receptacle having a plurality of slots, each having electrical contact means to receive the blades of an electrical plug;

(b) said plug having a plate pierced by said blades and elongated posts on said plate and disposed adjacent each said blade;

(c) a face plate fitted over said receptacle, said face plate having apertures to accept said receptacle and said posts;

(d) a plurality of normally open switches carried by said face plate connected in series between each of said incoming wires and said terminal posts, the said switches each having an operating arm arranged to be engaged and moved to a closed position by said elongated posts, whereby the electrical connection between the incoming and outgoing wires is complete only when the said plug and said plate are in their fully received positions.

2. The invention according to claim 1 wherein the said plate carried by the said plug is formed of an insulating material.

3. The invention according to claim 1 wherein the said outlet receptacle is a duplex outlet receptacle.

* * * * *